US005244420A

United States Patent [19]

Lopata

[11] Patent Number: 5,244,420

[45] Date of Patent: Sep. 14, 1993

[54] ELECTRICAL CONNECTOR ASSEMBLY

[75] Inventor: John E. Lopata, Naperville, Ill.

[73] Assignee: Molex Incorporated, Lisle, Ill.

[21] Appl. No.: 924,128

[22] Filed: Aug. 3, 1992

[51] Int. Cl.[5] ..... H01R 13/00

[52] U.S. Cl. ..... 439/699

[58] Field of Search ..... 439/699

[56] References Cited

U.S. PATENT DOCUMENTS 2,356,752 8/1944 Deysher ..... 439/699

4,643,509 2/1987 Hollyday et al. ..... 339/147 R

*Primary Examiner*—Joseph H. McGlynn

*Attorney, Agent, or Firm*—Charles S. Cohen

[57] ABSTRACT

An electrical connector assembly includes a plurality of terminals, each terminal including a contact leaf portion and an insulation displacement portion generally perpendicular to the contact leaf portion. An elongated insulating housing includes a plurality of receptacles for receiving the terminals with the insulation displacement portions exiting the housing for displacing the insulation of a plurality of insulated conductors outside the housing. The housing has a plurality of channels extending from the receptacles for receiving the contact leaf portions of the terminals. The channels have flanges only partially closing the channels over the distal ends of the contact leaf portions to prevent the contact leaf portions from lifting out of the channels. The housing also has platforms for supporting bottom sides of the insulation displacement portions of the terminals. A mounting block is mounted on top of the housing and includes a plurality of outward projections for supporting the top sides of the insulation displacement portions of the terminals. The mounting block includes troughs in alignment with the outward projections for receiving the insulated conductors.

9 Claims, 10 Drawing Sheets

ELECTRICAL CONNECTOR ASSEMBLY

FIELD OF THE INVENTION

This invention generally relates to the art of electrical connectors and, particularly, to an electrical connector having features for supporting and protecting thin insulation displacement terminals mounted in the connector.

BACKGROUND OF THE INVENTION

With the ever-increasing miniaturization of electrical connector assemblies and the ever-increasing density of terminals mounted in the assemblies, it is becoming increasingly difficult to design the connectors to sufficiently support or protect small terminals from damage or deformation either during manufacture or assembly of the connectors or during mating and unmating of the connectors with complementary connectors.

For instance, a type of shielded input/output electrical connector includes an elongated housing having a plurality of receptacles or through passages extending in rows lengthwise of the connector for receiving a plurality of terminals for mating or establishing contact with terminals of a similarly configured complementary connector. The housing is shielded and the shield usually defines the mating front portion of the connector. Conductors are terminated to the terminals on the back or rear side of the housing projecting from the rear of the shield. Such connector assemblies increasingly are being miniaturized with high density terminal configurations. For instance, a typical connector assembly may have on the order of 34 terminals in each of the two rows of terminals spanning a distance of less than 1.5 inches, with the terminals in the combined rows having a spacing or pitch on the order of 0.050 inch.

In connector assemblies of the character described above, a typical tiny terminal conventionally is stamped and formed of metal material, and the terminal may be as thin as 0.0120 inch. A typical terminal also may be of the insulation displacement type, with a slotted insulation displacement portion at one end of the terminal and a thin elongated contact portion at the opposite end of the terminal. The elongated contact portion may be disposed in a channel or groove in the connector housing for contacting a complementary terminal of a mating connector. One of the problems in manufacturing such electrical connectors is providing stability or support for the insulation displacement portion of the contact. The very thin contact has a tendency to buckle during displacement of the insulation of an insulated conductor rather than cutting through the insulation to establish contact with the conductor core. Another problem involves the thin elongated contact portion of the terminal because it has a tendency to lift out of its channel or groove in the connector housing.

This invention is directed to solving the above problems by providing features on the connector housing for stabilizing and supporting the thin terminals both during manufacture or assembly thereof as well as during mating and unmating of the connector with a complementary connector assembly.

SUMMARY OF THE INVENTION

An object, therefore, of the invention is to provide a new and improved electrical connector assembly of the character described for solving the stated problems and satisfying the need for an improved terminal mounting and supporting means on the connector assembly.

In the exemplary embodiment of the invention, the electrical connector assembly includes a plurality of terminals, each including a contact portion and an insulation displacement portion generally perpendicular to the contact portion. An elongated insulating housing has a plurality of receptacles for receiving the contact portions of the terminals generally transversely of the elongated housing. The insulation displacement portions of the terminals exit the housing for displacing the insulation of a plurality of insulated conductors or wires outside the housing. The housing has platform means for supporting bottom sides of the insulation displacement portions of the terminals. A mounting block is mounted on top of the housing and includes a plurality of outward projections for respectively supporting a top side of each of the insulation displacement portions of the terminals. The housing includes a plurality of partitions disposed between the projections of the mounting block when the block is mounted on the housing, and the partitions support lateral sides of the insulation displacement portions of the terminals.

The mounting block has rounded entries for receiving and retaining the insulated conductors or wires. The sides of the entries have sharp edges for piercing the insulation of the wires to provide a retention feature.

As disclosed herein, the contact portions of the terminals are in the form of elongated contact leafs projecting from the termination portions of the terminals. The insulating housing includes a plurality of receptacles for receiving the insulation displacement terminal portions, and a plurality of channels extend from the receptacles for receiving the contact leaf portions of the terminals. The channels include web means only partially closing the channels over the distal ends of the contact leaf portions to prevent the contact leaf portions from lifting out of the channels.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
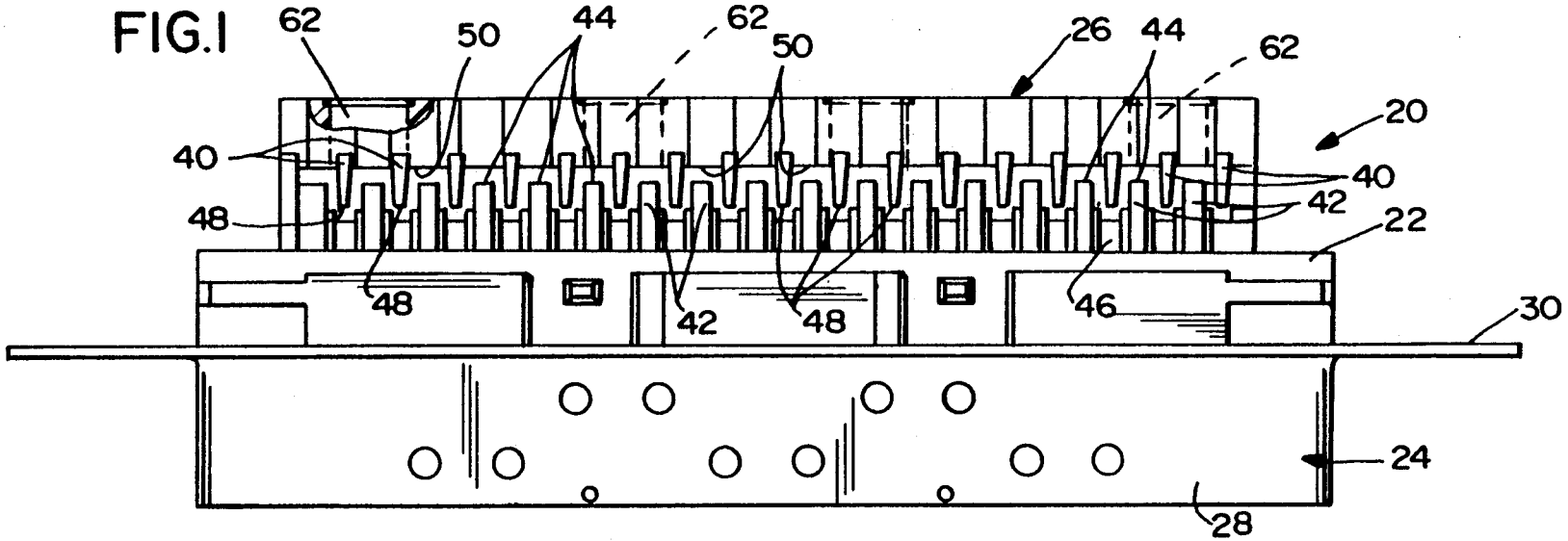
FIG. 1 is a partially fragmented side elevational view of an electrical connector assembly embodying the concepts of the invention, with the terminals of the assembly removed in order to avoid cluttering the depiction.
Figure 2:
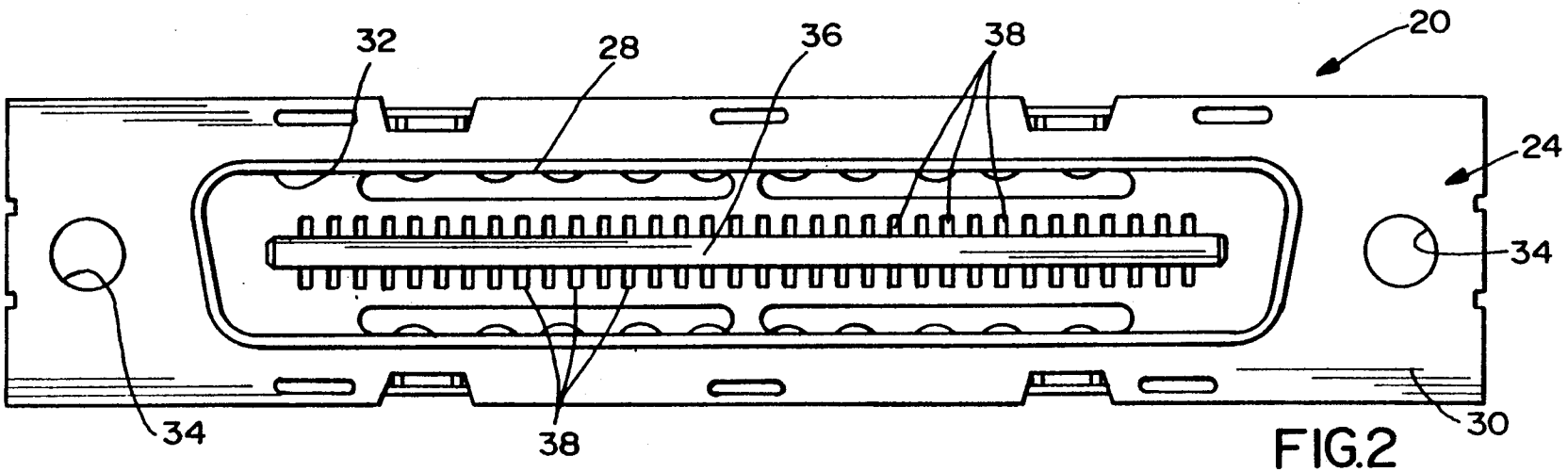
FIG. 2 is a bottom plan view of the electrical connector assembly as shown in FIG. 1.

Referring to the drawings in greater detail, and first to FIGS. 1 and 2, the features of the invention are disclosed in an electrical connector assembly, generally designated 20, of a shielded input/output type. A similar type of electrical connector assembly is shown in U.S. Pat. No. 5,052,949 to Lopata, et al, dated Oct. 1, 1991, assigned to the assignee of this invention and which is incorporated herein by reference for showing details of the connector assembly not described herein. Suffice it to say for the purposes of the instant invention, electrical connector 20 includes an insulating, elongated housing, generally designated 22, a metal shield, generally designated 24 and a mounting block, generally designated 26.

Shield 24 is of a conventional configuration and includes a shielding shroud portion 28 surrounded by a laterally extending flange portion 30. Shroud portion 28, as can be seen best in FIG. 2, defines a receptacle 32 for receiving the mating portion of a complementary connector assembly. Flange portion 30 has a plurality of holes 34 for mounting the connector assembly to an appropriate structure.

Housing 22 includes a projecting wall 36 (FIG. 2) protruding into shroud portion 28 of shield 24, with a plurality of receptacles 38 being visible on opposite sides of wall 36 and through which contact portions of a plurality of terminals (as described hereinafter) project so that the contact portions lie against opposite sides of wall 36 for engaging complementary terminals of the mating connector.

Referring back to FIG. 1, mounting block 26 includes a plurality of outwardly protruding projections 40, the lower ends of which are located alternatingly between a plurality of partitions 42 defined by housing 22. The tops of partitions 42 define upper platform means 44 on the housing, and surface areas 46 between the partitions define lower platform means on the housing. In addition, lower edges 48 of projections 40 of mounting block 26 define lower support means opposing lower platform means 46 on the housing, and upper surface areas 50 on the mounting block, between the projections, define upper support surfaces opposite the upper platform means defined by the tops of partitions 42 of the housing. All of these platform means and support surfaces are provided for supporting insulation displacement portions of terminals mounted in the connector assembly, as described immediately below.

Figure 3:
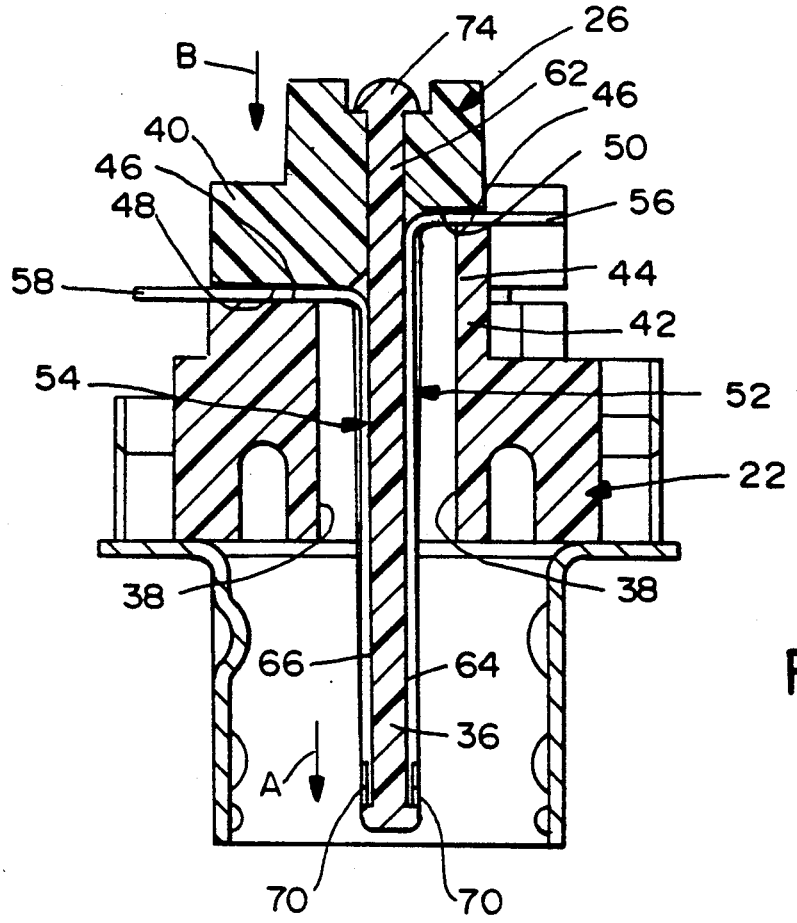
FIG. 3 is a vertical section, on an enlarged scale, taken generally along line 3—3 of FIG. 1, but with the terminals properly located within the assembly.

More particularly, referring to FIG. 3, a section through the connector assembly of FIG. 1 is illustrated, but with the terminals located within the assembly. Specifically, the terminals include an "upper" terminal, generally designated 52, and a "lower" terminal, generally designated 54. Although the contact portions of the terminals are identical, the terms "upper" and "lower", as well as such terms as "top" and "bottom", have been used herein or in the claims hereof simply to indicate that terminals 52 and 54 have insulation displacement portions 56 and 58, respectively, which are located in upper and lower dispositions relative to the connector assembly as depicted in the drawings. However, it should be understood that these terms are used herein for reference purposes only, and not in a limiting manner, to provide a clear understanding of the description, in that the connector assembly, when in manufacture or in use, is omnidirectional depending upon the particular application of the connector assembly in a given system.

Still referring to FIG. 3, it can be seen that upper platform means 44 defined by the top of one of the partitions 42 on housing 22, and one of the surface areas 50 of mounting block 26 sandwich insulation displacement portion 56 of upper terminal 52 therebetween. This sandwiching of the insulation displacement portion of terminal 52 prevents the insulation displacement portion from buckling when the terminal is terminated to an insulated conductor.

Similarly, looking at FIG. 1 and the left-hand side of FIG. 3, the lower edge 48 of one of the projections 40 on mounting block 26, and surface area 46 on housing 22 sandwich insulation displacement portion 58 of lower terminal 54 therebetween. Again, this sandwiching of the insulation displacement portion of terminal 54 supports the insulation displacement portion and prevents it from buckling during displacement of the insulation of an insulated conductor. In addition, projections 40 of mounting block 26 provide lateral support for insulation displacement portions 56 of upper terminal 52, and partitions 42 on housing 22 provide lateral support for insulation displacement portions 58 of lower terminals 54.

Figure 5A:
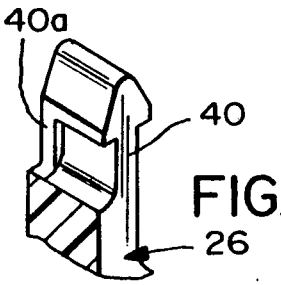
FIG. 5A is a fragmented perspective view of one of the channels, with a terminal about to be inserted thereinto.

FIG. 5A shows one of the projections 40 of mounting block 26. It can be seen that the projection has a thin web 40a (on both sides of the projection) which may be on the order of 0.010 inch wide. These webs provide a retention feature by cutting into the insulation of the insulated conductors or wires.

Figure 6:
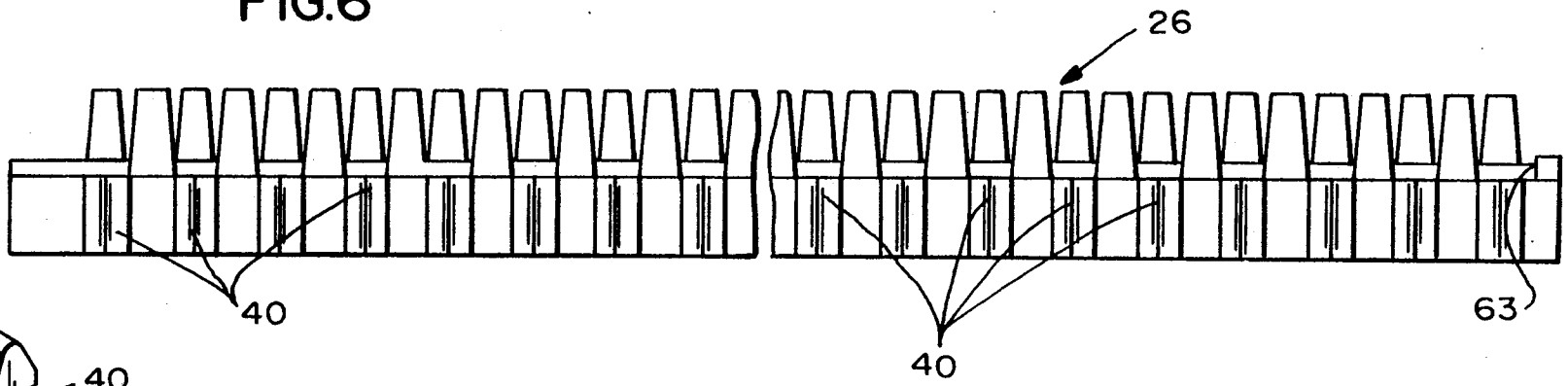
FIG. 6 is a fragmented side elevational view of the mounting block of FIG. 5.
Figure 5:
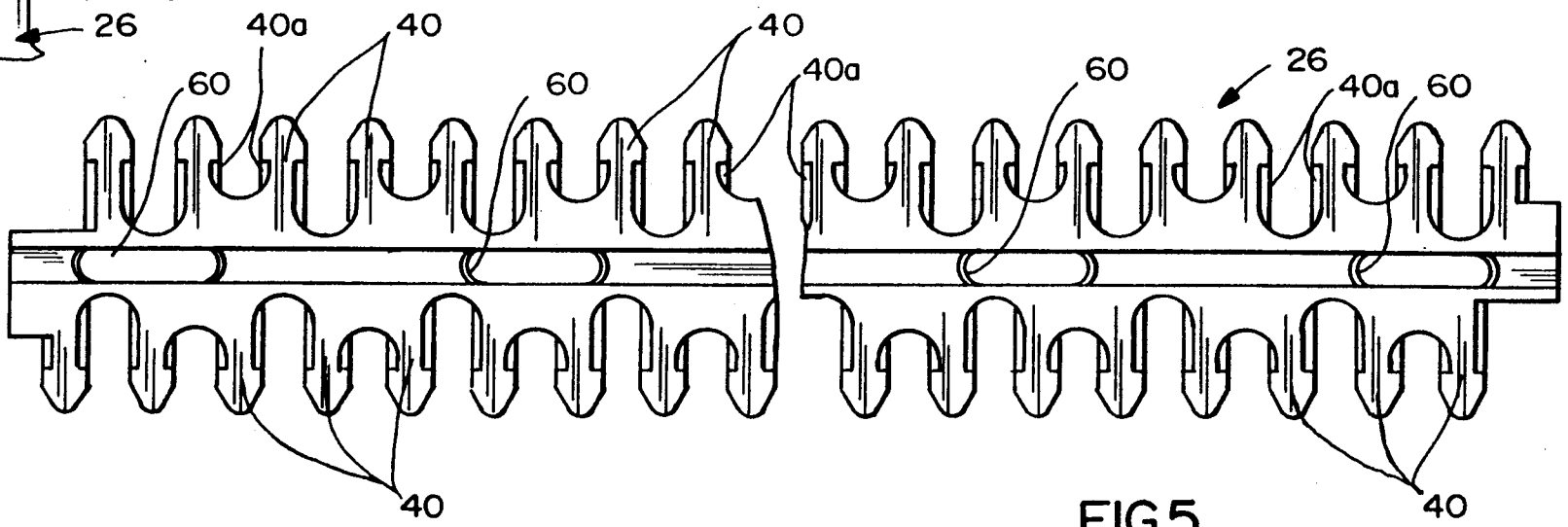
FIG. 5 is a fragmented bottom plan view of the mounting block of the connector assembly.

Referring to FIGS. 5 and 6 in conjunction with FIGS. 1 and 3, it should be understood that upper and lower terminals 52 and 54, respectively, are mounted not only in alternating arrays in two rows along opposite sides of wall 36 (FIG. 2) of housing 22, but the upper and lower contacts also alternate in each respective row lengthwise of the elongated housing. This can be understood by the alternating disposition of projections 40 on mounting block 26 as illustrated in FIGS. 5 and 6. Therefore, as seen in FIG. 1, housing partitions 42 alternate between mounting block projections 40, and the opposite side of the connector assembly has a similar array but in opposite relative dispositions of the partitions and projections. Consequently, polarizing means is provided between the mounting block and the housing. An exemplary embodiment of a polarizing means is shown in the form of a plurality of through holes 60 (FIG. 5) in mounting block 26 for receiving a plurality of tabs 62 (FIG. 1) projecting upwardly from housing 22. The tabs are insertable into holes 60, and the tabs/holes are complementarily irregularly spaced so that the mounting block can be mounted on the housing only in one disposition whereby projections 40 on the mounting block will seat between partitions 42 on the housing. As seen in FIG. 6, mounting block 26 also has a polarization projection 63 at one end. This projection is used to orient the mounting block in a feeder bowl during assembly of the connector.

Figure 4:
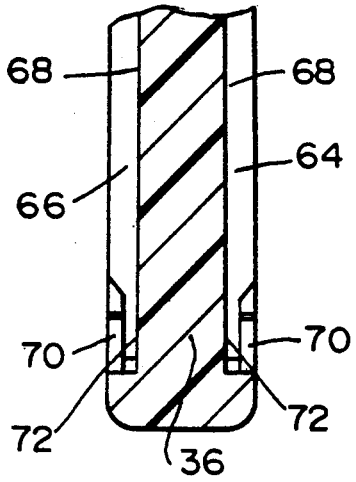
FIG. 4 is a fragmented section, on an enlarged scale, showing the distal ends of the channels and terminal contact leafs as seen at the left-hand end of the housing in FIG. 3.
Figure 7:
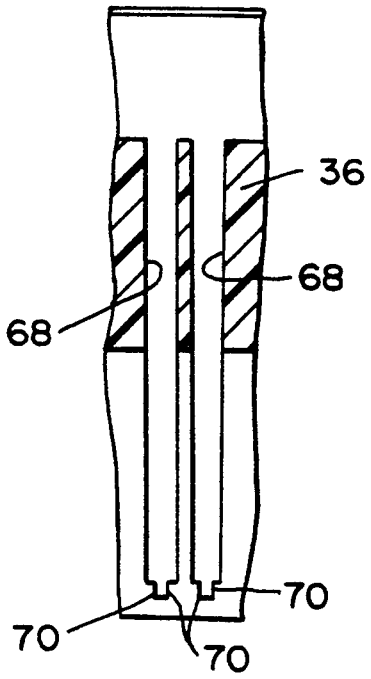
FIG. 7 is a fragmented elevational view, partially in section, through the housing to show the configuration of the channels for receiving the contact leafs of the terminals.

Referring to FIGS. 4 and 7 in conjunction with FIG. 3, terminals 52 and 54 have substantially identical contact leaf portions 64 and 66, respectively, except that contact leaf portion 64 of upper terminal 52 is longer than contact leaf portion 66 of lower terminal 54. Contact leaf portions 64 and 66 are disposed in passages or receptacles 38 on opposite sides of wall 36 of the housing as seen in FIG. 3 and as described above in relation to FIG. 2. Opposite sides of wall 36 are provided with channels 68 (see FIGS. 4 and 7) within which contact leaf portions 64 and 66 are located.

Another feature of the invention is the provision of means to prevent contact leaf portions 64 and 66 of upper and lower terminals 52 and 54, respectively, from lifting out of their respective channels 68 during either manufacturing or handling, but particularly in response to mating or unmating of the connector with a complementary connector assembly having terminals which engage the contact leaf portions on opposite sides of housing wall 36.

More particularly, as seen in FIGS. 4 and 7, web means in the form of a pair of flanges 70 are molded integrally with wall 36 of housing 22 so that the flanges project only partially laterally into the channels, at the base of the channels, near the distal end of wall 36. As seen in FIGS. 3 and 4, the flanges do not project outwardly from the sides of wall 36 so as not to interfere with mating of the contact leaf portions with mating terminals. In other words, the flanges are located within the depths of the channels.

As seen in FIG. 4, the distal ends of the contact leaf portions 64 and 66 are flattened, as by coining, to reduce the thickness thereof, as at 72, so that the distal ends of the contact leaf portions seat under flanges 70. With this configuration, the distal ends of the contact leaf portions are locked under the flanges when the terminals are inserted into the housing in the direction of arrow "A" (FIG. 3), and the contact leaf portions cannot lift out of the channels.

In manufacture, terminals 52 and 54 are "stitched" into housing 22 by inserting contact leaf portions 64 and 66 into receptacles or passages 38 in the housing, as indicated by arrow "A", until the flattened distal ends of the contact leaf portions seat and lock under flanges 70 at the bases of channels 68. Mounting block 26 then is assembled to the housing in the direction of arrow "B" (FIG. 3), to sandwich and support insulation displacement portions 56 and 58 of the terminals, as described above. Polarizing tabs 62 can be retained by heat staking, or other methods, as represented at 74 (FIG. 3) to lock the mounting block on top of the housing and to secure the terminals therewithin.

Figure 8:
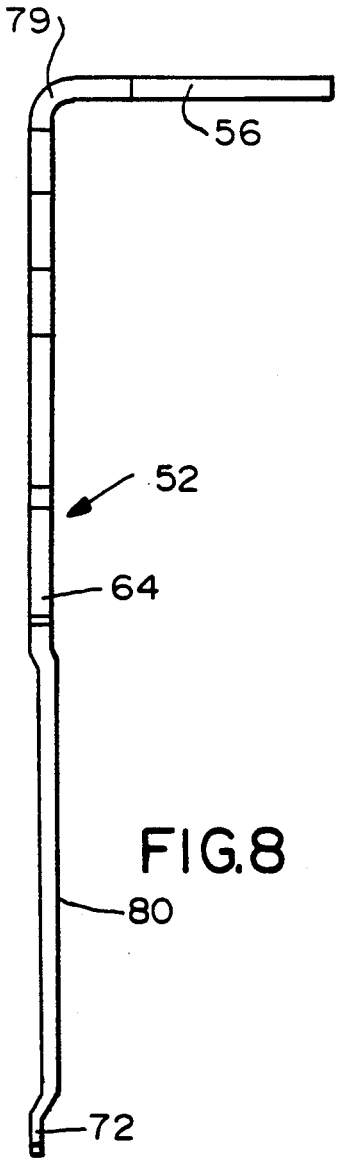
FIG. 8 is a side elevational view of the "upper" terminal shown in FIG. 3.
Figure 10:
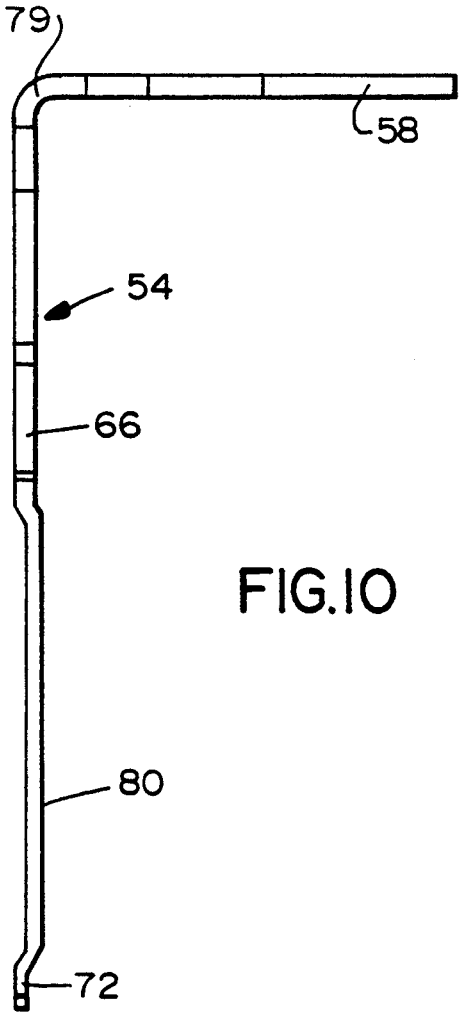
FIG. 10 is a side elevational view of the "lower" terminal shown in FIG. 3.
Figure 9:
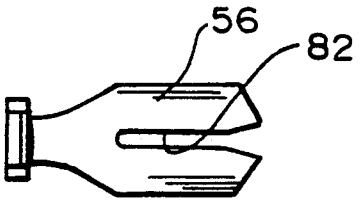
FIG. 9 is a bottom plan view of the terminal shown in FIG. 8.
Figure 11:
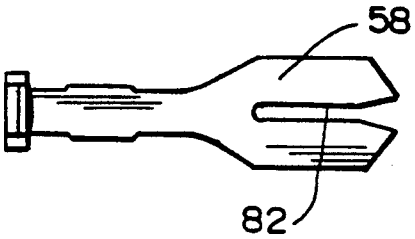
FIG. 11 is a bottom plan view of the terminal shown in FIG. 10.

FIGS. 8 and 9 show the stamped and formed configuration of one of the upper terminals 52, and FIGS. 10 and 11 show the stamped and formed configuration of one of the lower terminals 54. As stated above, contact leaf portions 64 and 66 of the upper and lower terminals 52 and 54, respectively, are substantially identical for positioning in the channels 68 described above. The only difference in the terminals is the location of a bend or radius 79 for forming the contact leaf portions. The terminals are bent at different locations so that insulation displacement portions 56 and 58 are at different heights relative to the longitudinal axis of the connector. Flattened areas 72 at the distal ends of the contact leaf portions are shown in FIGS. 8 and 10 for the respective terminals. Both contact leaf portions also have formed or crowned contact areas 80 which project outwardly of the channels for ensuring contact with the mating terminals of a complementary connector.

FIGS. 8–11 also show that upper and lower terminals 52 and 54, respectively, have insulation displacement portions 56 and 58, respectively, which are bifurcated by means of slots 82 whereby the slots pierce the insulation about appropriate insulated conductors. The only difference between the upper and lower terminals is that the termination ends of the terminals which include insulation displacement portions 56 and 58 are of different lengths as shown in FIGS. 8–11. This also can be seen in the assembly of the connector as described in relation to FIG. 3. The supporting means between the housing and the mounting block for the insulation displacement portions of the terminals, as described above in relation to FIGS. 1 and 3, prevent the insulation displacement portions from buckling when insulated conductors are terminated in slots 82 (FIGS. 9 and 11) of the insulation displacement portions of the terminals.

Figure 13:
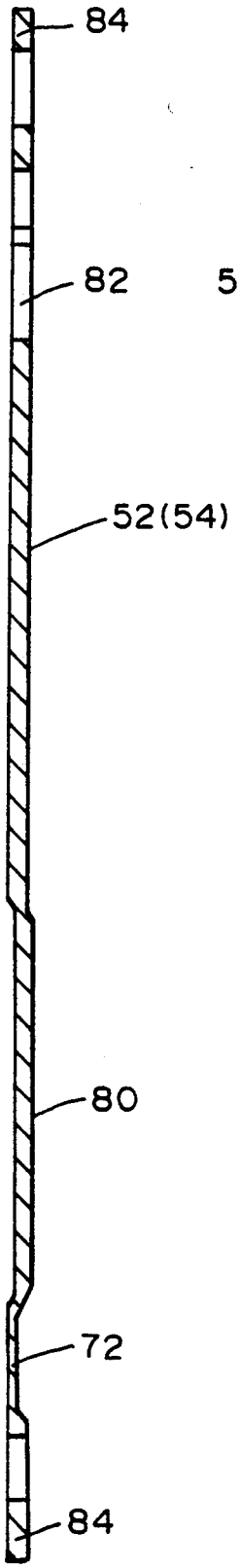
FIG. 13 is a section taken generally along line 13—13 of FIG. 12.
Figure 12:
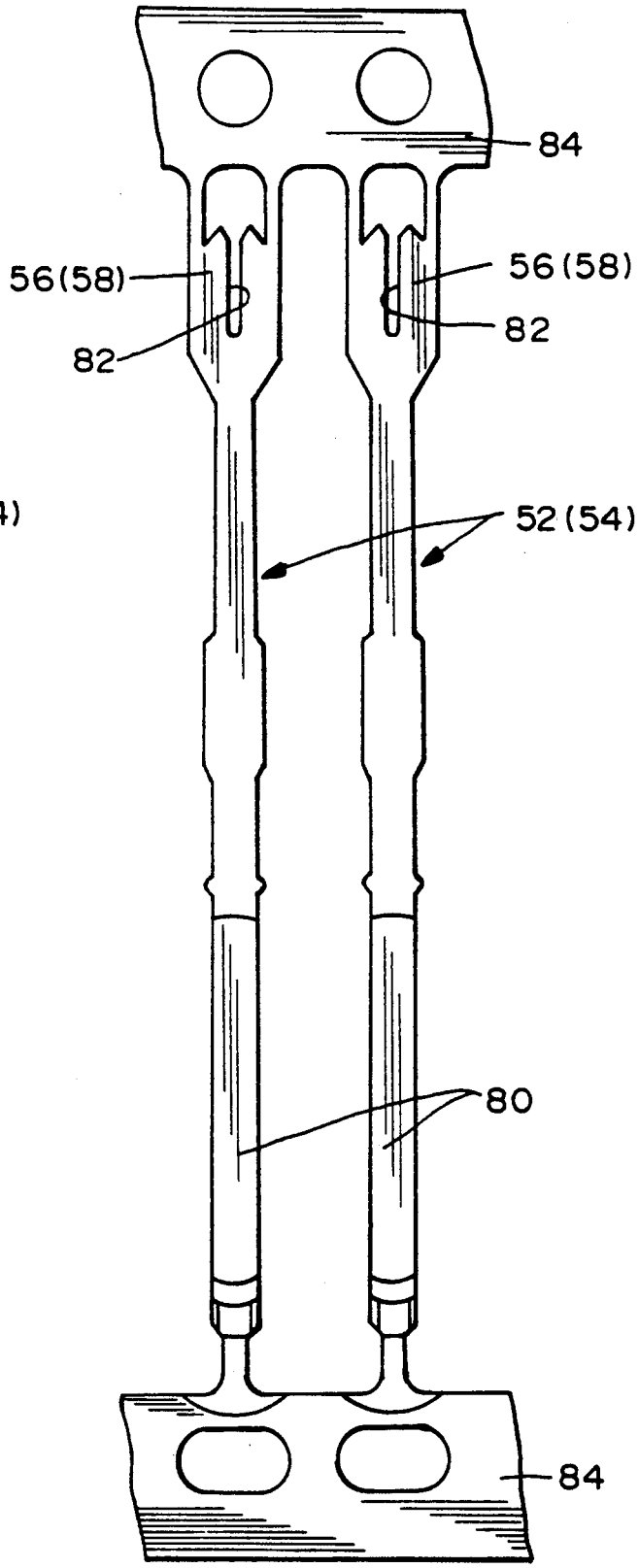
FIG. 12 is a plan view of a metal blank showing how the terminals, particularly the "upper" terminal, are stamped and formed from a continuous strip of metal material.

FIGS. 12 and 13 show how upper and lower terminals 52 and 54 are stamped and formed from thin sheet metal material, on the order of 0.012 inch thick. The terminals are shown stamped from a blank of metal material, but the terminals still are connected to continuous carrier webs 84 as is conventional in stamping operations. Both of the blanks 52 (54) shown in FIG. 12 are of identical size and either blank can be formed into either upper and lower terminal 52 or 54, respectively, depending upon where the blank is bent. In other words, a comparison of FIG. 12 should be made with FIGS. 8 and 10.

As seen in FIG. 13, during the stamping operations, contact areas 80 are formed in the terminals, and flattened areas 72 also are formed, such as in a coining operation. Coining the flattened areas 72 results in the distal ends of the leaf portions of the terminals having a thickness on the order of 0.005 inch. The blanks then are cut from carrier webs 84 and bent into their respective right-angular configurations as shown in FIGS. 8 and 10.

Figure 14:
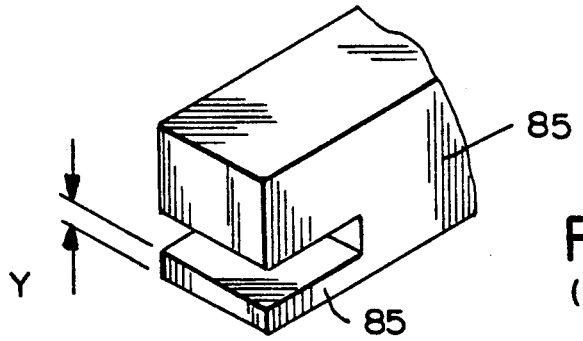
FIG.14 (PRIOR ART)
FIG. 14 is a fragmented perspective view of a typical core component for molding the housing according to prior art teachings.

As stated above, when flattened areas 72 at the distal ends of terminals 52 and 54 are coined, the thickness of each distal end is on the order of 0.005 inch. This very small dimension can cause problems in molding a blind or closed area at the ends of channels 68 in housing wall 36 in order to capture or retain the distal ends of the terminals. In order to mold a blind cavity on the order of 0.005 inch deep, a corresponding die or mold core component would have to be correspondingly dimensioned. More specifically, referring to FIG. 14, a fragmented view of a typical core 85 is shown with a thin core portion or component 85*a*. This core component would be required to mold such a blind cavity and the thickness "y" would be on the order of 0.005 inch thick. Such a thin, usually metal, core component would be impractical and subject to continuous breaking.

Figure 14A:
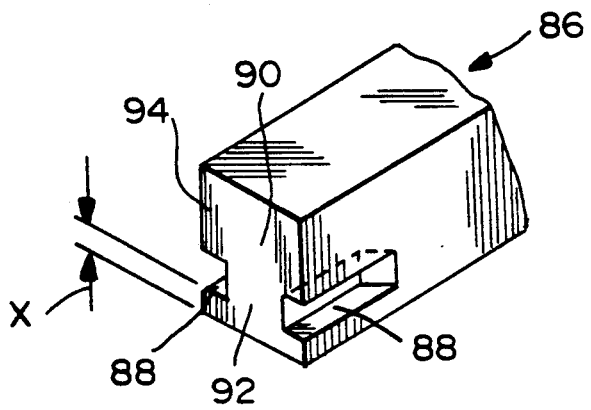
FIG. 14A is a fragmented perspective view of a core component for facilitating molding of the housing to capture the distal ends of the terminal contact leafs, according to the invention.

Consequently, as stated above, the pair of flanges 70 are molded so that the flanges project only partially laterally into channels 68. This arrangement increases the manufacturability of housing 22 and particularly wall 36 thereof. In order to exemplify this point, FIG. 14A shows a fragmented view of a core component, generally designated 86, which has cut out areas 88 in the sides thereof. The cut out areas effectively form flanges 70 which project only partially across channels 68. By not having a continuous flange extending entirely across a particular channel (as represented by typical core 85,85*a* in FIG. 14), a support rib 90, between cut out areas 88 of core component 86 can be employed to join a lower, very thin portion 92 of the core component with a much larger and rigid body portion 94 of the core component. Without rib 90, the thickness of lower portion 92, as indicated by arrows "X" would be on the order of 0.005 inch or just slightly larger to accommodate the thickness of flattened, coined areas 72 of the terminal. As stated above, such a very thin portion of the core component would have a tendency to break or deform, without the support provided by rib 90. Yet, flanges 70 of wall 36 of housing 22, at the closed ends of channels 68, are sufficient to retain the distal ends of the leaf portions of the terminals.

Figure 14B:
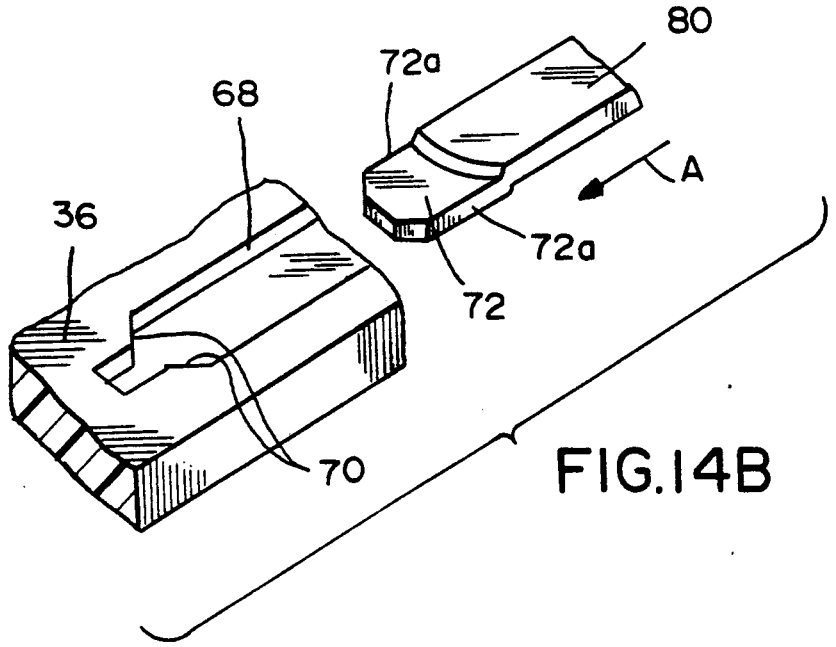
FIG. 14B is a fragmented perspective view of the distal end of a channel and a terminal being inserted into the channel.

FIG. 14B shows a fragmented portion of wall 36 of housing 22, along with one of the channels 68 having flanges or webs 70 at the base of the channel, the flanges projecting only partially laterally into the channel. This structural configuration is molded by the core configuration described above in relation to FIG. 14A. The flattened, coined area 72 of a terminal is inserted into the channel in the direction of arrow "A", until shoulder portions 72*a* of the terminal are captured under flanges 70.

Figure 15:
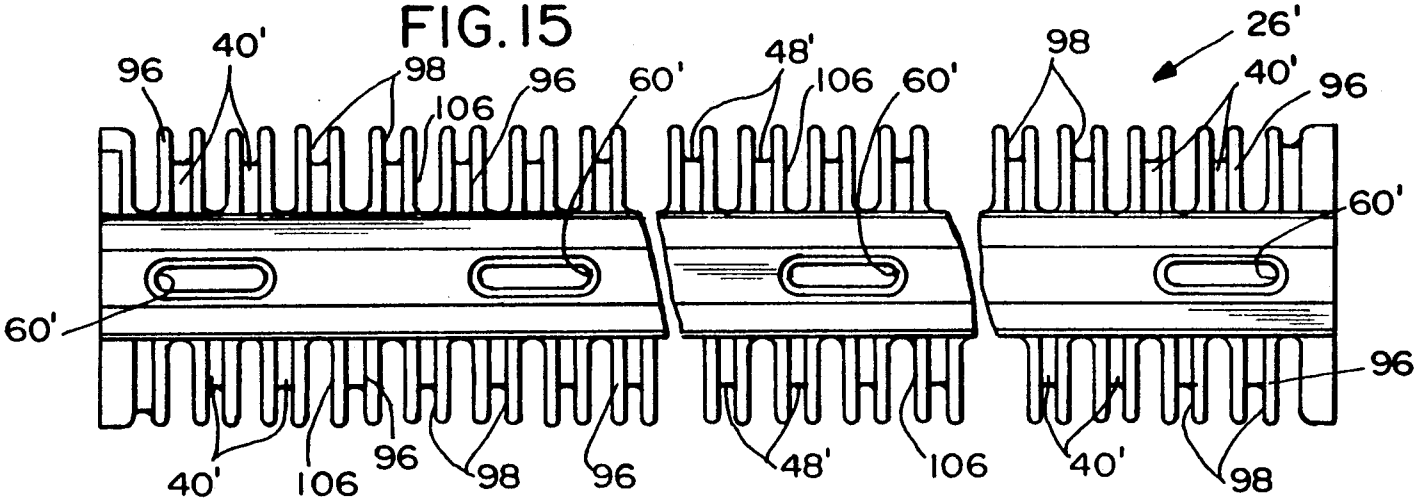
FIG. 15 is a view similar to that of FIG. 5, but of an alternate form of the mounting block.
Figure 16:
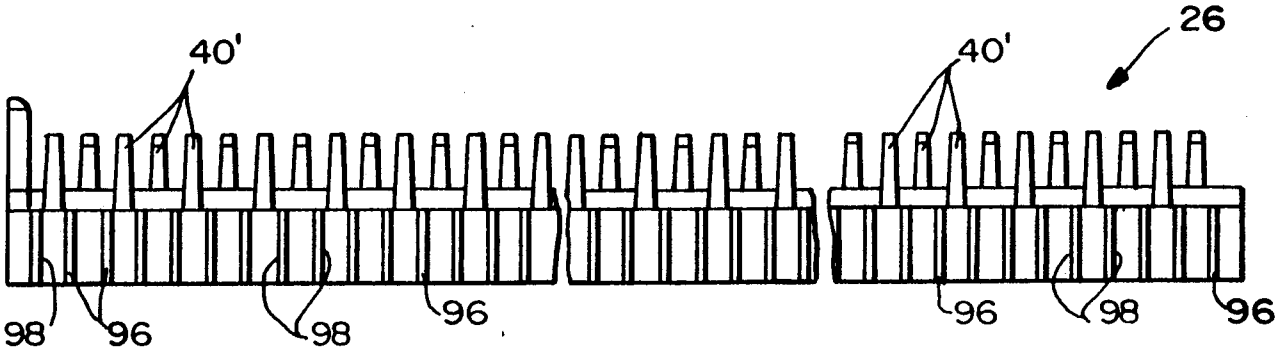
FIG. 16 is a fragmented side elevational view of the mounting block of FIG. 15.
Figure 17:
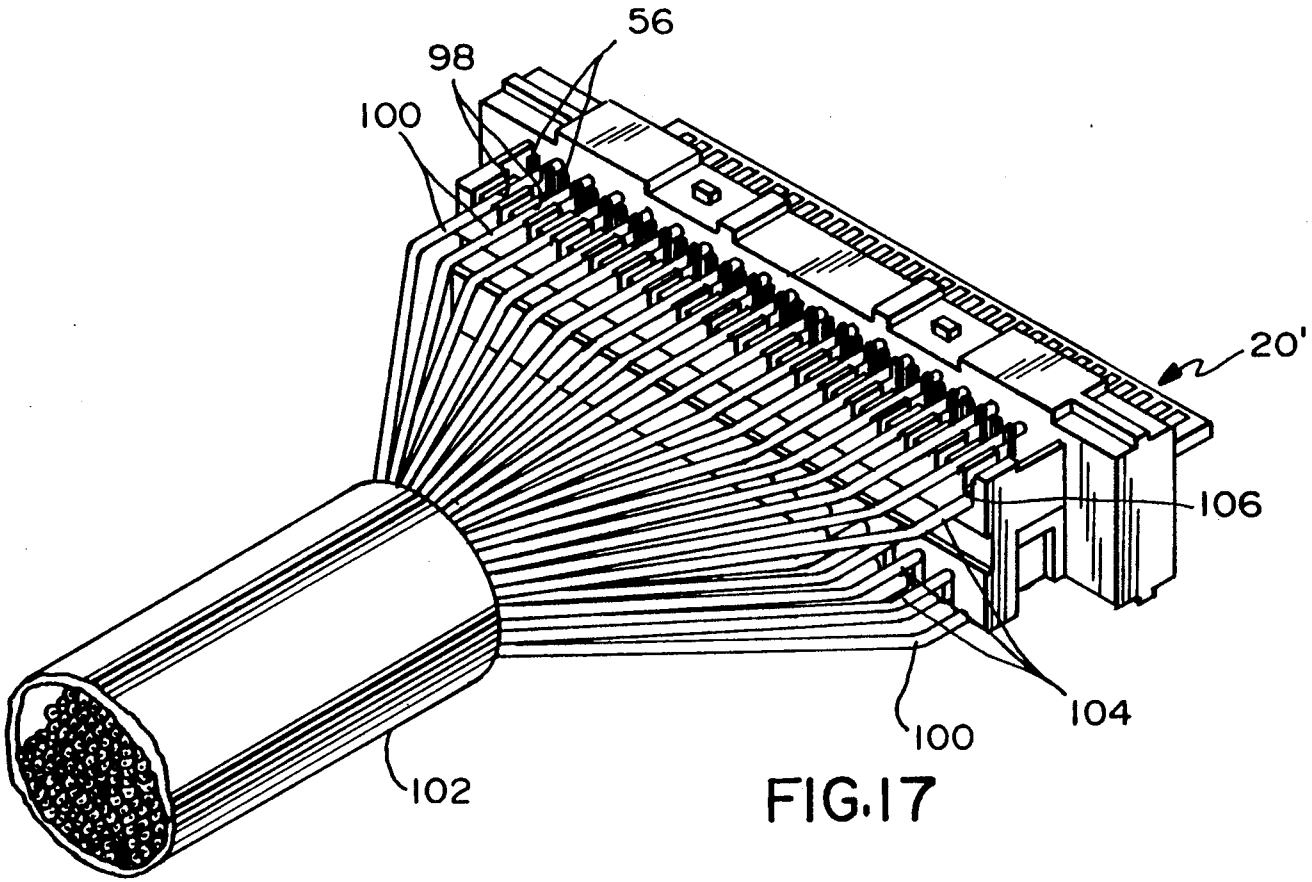
FIG. 17 is a perspective view of a connector assembly incorporating the mounting block of FIG. 15, and terminating a plurality of insulated conductors.
Figure 18:
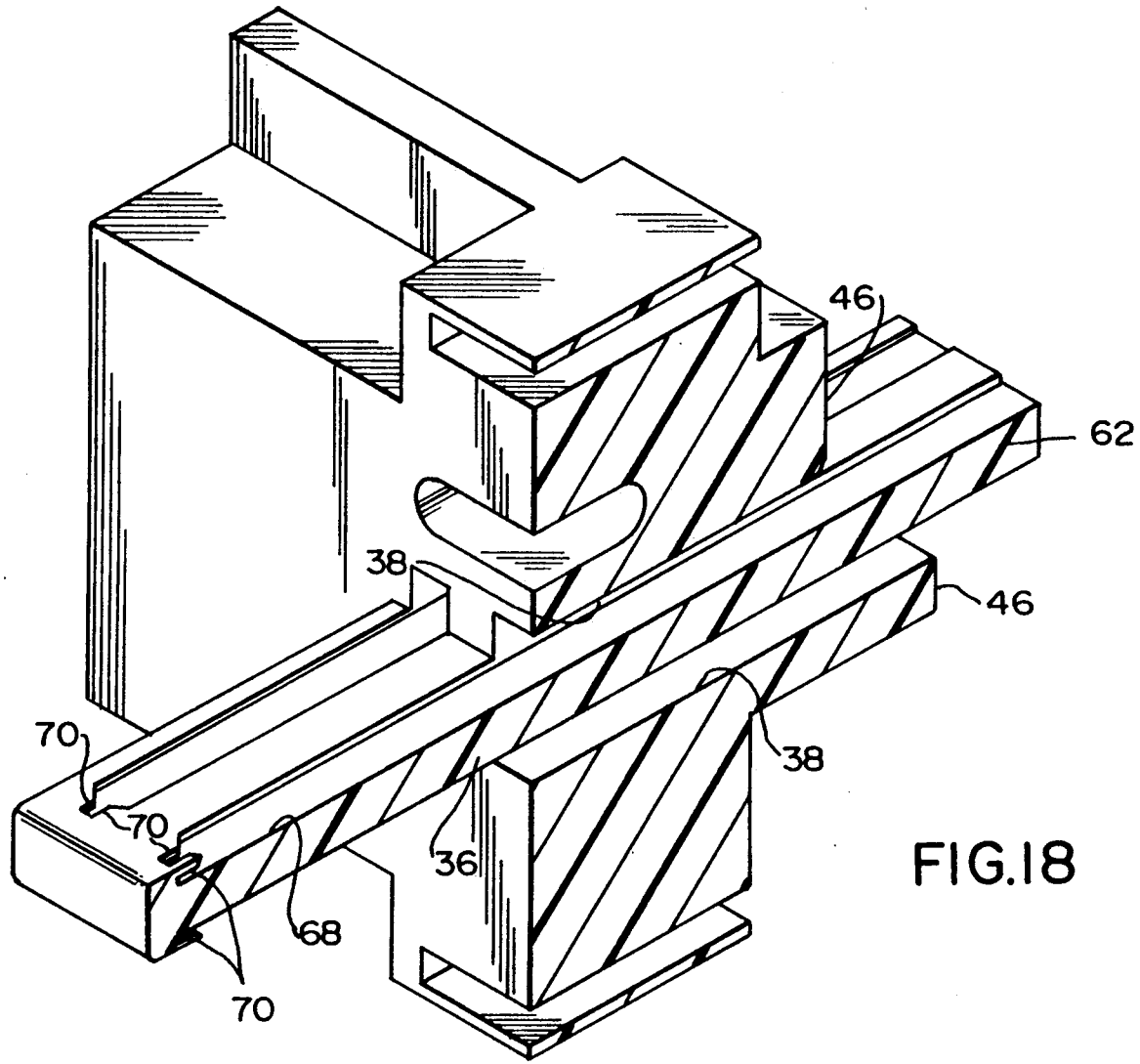
FIG. 18 is a perspective view of the housing of the connector taken in section similar to FIG. 3.
Figure 19:
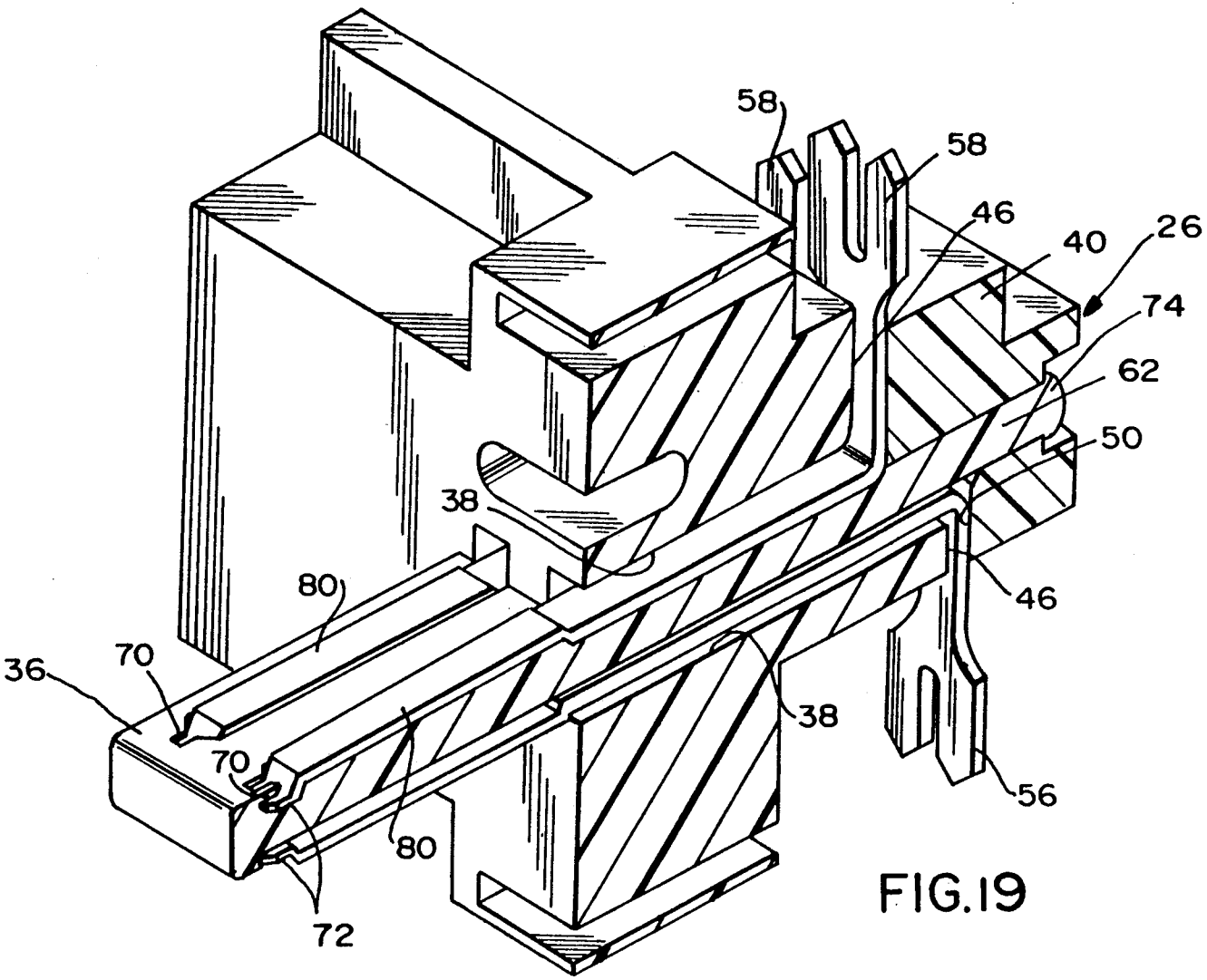
FIG. 19 is a perspective view similar to that of FIG. 18 but with the terminals positioned in the housing and with the mounting block securing the terminals therein.

FIG. 15 shows a modified form of a mounting block, generally designated 26', which includes outwardly protruding projections 40' and through holes 60' for purposes described above in relation to mounting block 26. However, it should be noted that mounting block 26' has a plurality of ribs 96 which define troughs 98 in line with edges 48' of projections 40. As seen by the perspective view of a connector assembly, generally designated 20' in FIG. 17, troughs 98 seat insulated conductors 100 of a multi-conductor electrical cable 102, whereby the conductors are aligned with the insulation displacement portions 56 of "upper" terminals 52 of the respective terminals. The troughs prevent the insulated conductors 100 from overlapping or becoming commingled with conductors 104 which are terminated with insulation displacement portions 56 of "lower" terminals 52 (not visible in the drawing), during a "stitching" operation of terminating the conductors to the insulation displacement terminals. The conductors 104 for the lower terminals are seated in rounded-entry troughs 106 which, as seen in FIG. 15, are deeper than troughs 98.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In an electrical connector including a dielectric housing, said housing having a base and a blade member integrally formed with and extending from said base, said blade member being narrower than said base in a direction perpendicular to a longitudinal axis through said connector and having a top side, a bottom side and a leading edge, said base having a plurality of terminal receiving cavities through which terminals extend and said blade member having a plurality of channels along the top and bottom sides thereof and aligned with said terminal receiving cavities, said channels having opposed sidewalls;

a plurality of stamped and formed terminals mounted within respective ones of said terminal receiving cavities, at least one terminal extending along each of said top and bottom sides of said blade member, each said terminal having a conductor termination portion for termination to respective electrical conductors, a terminal front end for securement adjacent the leading edge of said blade member, and an elongated contact leak portion located between the termination portion and the terminal front end with a portion of said elongated contact leaf portion being positioned in one of said channels, said elongated contact leaf portion further including a contact area projecting outwardly of its channel for contacting a complementary mating terminal;

wherein the improvement comprises:

each said channel including web means extending from each of said sidewalls thereof only partway towards the longitudinal centerline of the channel to only partially close the channel adjacent the leading edge of said blade member, whereby said web means extends over a portion of the terminal front end of each terminal to prevent said contact leaf from lifting out of its channel.

2. The electrical connector of claim 1 wherein said terminals are stamped and formed metal components and said contact areas comprise formed portions of the terminals.

3. The electrical connector of claim 1 wherein said web means comprise a flange integrally formed with and projecting inwardly from the respective sidewall of the channel.

4. The electrical connector of claim 3 wherein each said flange is disposed within the depth of its channel, and the distal end of the contact leaf portion is flattened for seating under a pair of flanges.

5. The electrical connector of claim 4 wherein said terminals are stamped and formed metal components and the flattened distal ends of the contact leaf portions comprise coined portions of the terminals.

6. A leaf-type electrical connector assembly, comprising:

a plurality of stamped and formed terminals, each having a conductor termination portion and an elongated contact leaf portion projecting from the termination portion, the contact leaf portion having a flattened distal end and a raised contact area between the conductor termination portion and the flattened distal end of the contact leaf portion; and an insulating housing having a base and a blade member, said base including a plurality of receptacles for receiving the conductor termination portions of the terminals, a plurality of channels along a top surface and a bottom surface of said blade member and extending from the receptacles for receiving the contact leaf portions of the terminals, each channel being of a depth whereby the raised area of its contact leaf portion projects outwardly of the channel for contacting a complementary mating terminal, and the channel includes web means only partially closing the channel over the flattened distal end of the contact leaf portion to prevent the contact leaf portion from lifting out of the channel, and each said web means comprises flanges integrally formed with and projecting inwardly from opposite sides of its respective channel only partway towards the longitudinal centerline thereof.

7. The electrical connector of claim 6 wherein said flanges are disposed within the depth of the channels.

8. The electrical connector of claim 6 wherein said flattened distal end of the contact leaf portion comprises a coined portion of the terminal.

9. The electrical connector of claim 6 wherein said raised contact areas of the contact leaf portions comprise formed portions of the terminals.

* * * * *